US006364627B1

(12) United States Patent
Herder et al.

(10) Patent No.: US 6,364,627 B1
(45) Date of Patent: Apr. 2, 2002

(54) CONTROL VALVE MEANS IN AN EXTERNAL CONDUIT OF A VARIABLE DISPLACEMENT SWASH PLATE TYPE COMPRESSOR

(75) Inventors: David H. Herder, Plymouth; Lavlesh Sud; Shane A. Harte, both of Farmington Hills; Yong Huang, Ann Arbor, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/471,647

(22) Filed: Dec. 23, 1999

(51) Int. Cl.[7] ..... F04B 1/26
(52) U.S. Cl. ..... 417/222.2; 417/270; 417/307
(58) Field of Search ..... 417/222.2, 222.1, 417/270, 307, 439; 92/72; 91/473

(56) References Cited

U.S. PATENT DOCUMENTS 3,861,829 A * 1/1975 Roberts et al. ..... 417/270
4,730,986 A * 3/1988 Kayukawa et al. ..... 417/222.2
4,842,488 A 6/1989 Terauchi
4,867,649 A * 9/1989 Kawashima et al. ..... 417/270
5,242,274 A 9/1993 Inoue
5,567,124 A 10/1996 Takenaka et al.
5,620,310 A * 4/1997 Takenaka et al. ..... 417/222.2
5,702,235 A * 12/1997 Hirota et al. ..... 417/270
5,820,355 A * 10/1998 Ikeda et al. ..... 417/269
6,015,269 A * 1/2000 Ota et al. ..... 417/222.2

* cited by examiner

*Primary Examiner*—Cheryl J. Tyler
(74) *Attorney, Agent, or Firm*—Larry I. Shelton

(57) ABSTRACT

A variable capacity swash plate type compressor 10, which incorporates an inlet port 40 disposed in a crankcase 36 leading to a crank chamber 38. The inlet port 40 places the crank chamber 38 in the active flow path of a refrigerant gas for the compressor 10 and eliminates the need for an orifice tube in fluid communication with a discharge chamber 22 and the crank chamber 38 thereby increasing the maximum capacity of the compressor 10.

18 Claims, 2 Drawing Sheets

CONTROL VALVE MEANS IN AN EXTERNAL CONDUIT OF A VARIABLE DISPLACEMENT SWASH PLATE TYPE COMPRESSOR

FIELD OF THE INVENTION

The present invention relates generally to a variable capacity swash plate type compressor adapted for use in an air conditioning system for a vehicle. In particular, this invention relates to a swash plate type compressor having an inlet port disposed in the crankcase for fluid communication with the crank chamber and an outlet port disposed in a cylinder head for fluid communication with the discharge chamber to increase the capacity of the compressor, and eliminate the requirement for an orifice tube in fluid communication between the crank chamber and the discharge chamber.

BACKGROUND OF THE INVENTION

Variable capacity swash plate type compressors typically include a cylinder block provided with a number of cylinders, a piston disposed in each of the cylinders of the cylinder block, a rotatably supported drive shaft, and a swash plate. The swash plate is adapted to be rotated by the drive shaft. The rotation of the swash plate is effective to reciprocatively drive the pistons. The length of the stroke of the piston is varied by an inclination angle of the swash plate. The inclination angle of the swash plate is varied by controlling the pressure differential between a suction chamber and a crank chamber using a control valve. An orifice tube is also typically disposed to provide fluid communication between a discharge chamber and the crank chamber to recirculate compressed gases from the discharge chamber to the crank chamber.

In the prior art, the crank chamber has been an inactive part of the compressor flow strategy. The crank chamber pressure is typically regulated by monitoring the suction pressure of the suction chamber and the discharge pressure of the discharge chamber. The refrigerant gases travel through the compressor after initially being introduced through an inlet port disposed in the cylinder head of the compressor and thence to the suction chamber. The refrigerant gases are then introduced into the cylinders and expelled from the cylinders into the discharge plenum. A control valve is provided to control the flow of refrigerant gas between the suction chamber and the crank chamber depending on the pressure differential between the two chambers. Once in the discharge plenum, the refrigerant gases are expelled through an outlet port disposed in the cylinder head of the compressor or through the orifice tube to the crank chamber.

The compressor arrangement in the prior art described above has several disadvantages. First, the capacity of the compressor is reduced due to the presence of the orifice tube where high-pressure refrigerant gases are passed to the crank chamber and are not used in the cooling portion of the air-conditioning system. Second, due to the introduction of refrigerant gases through the inlet port into the relatively small suction chamber, vibration occurs requiring the use of a muffler in the inlet port or outlet port to dampen the vibration. Finally, effective lubrication of the close tolerance moving parts within the crank chamber due to the lack of a consistent flow through the crank chamber is also a concern.

An object of the invention is to produce a swash plate type compressor wherein the capacity of the compressor is maximized.

Another object of the invention is to produce a swash plate type compressor wherein the vibration of the compressor components is minimized to result in smoother operation of the compressor.

Another object of the invention is to produce a swash plate type compressor wherein the durability and duty cycle of the compressor are maximized.

Still another object of the invention is to produce a swash plate type compressor wherein lubrication is provided to the compressor components.

SUMMARY OF THE INVENTION

The present invention includes a variable capacity swash plate type compressor including a cylinder block; a cylinder head attached to the cylinder block and cooperating with the cylinder block to form an airtight seal, the cylinder head having a suction chamber and a discharge chamber formed therein; a crankcase attached to the cylinder block and cooperating with the cylinder block to define an airtight sealed crank chamber; a first conduit means providing fluid communication between the crank chamber and a source of refrigerant gas; and a second conduit means for exhausting refrigerant gas from the discharge chamber.

Various objects and advantages of this invention will become apparent to those skilled in the art from the following detailed description of the preferred embodiments, when read in light of the accompanying drawings.

DETAILED DESCRIPTION OF THE PREFERRED EMBODIMENT

Figure 1:
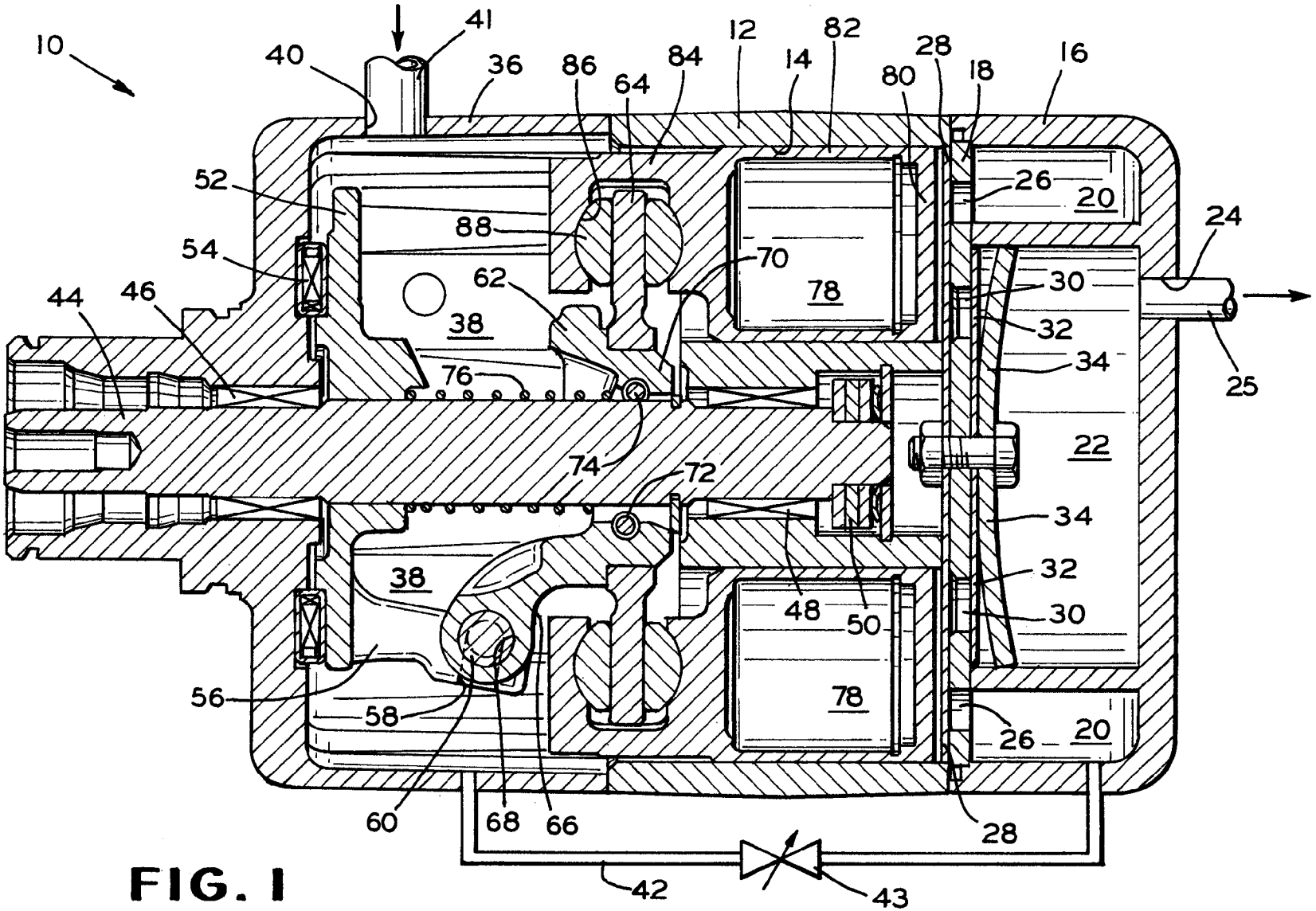
FIG. 1 is a sectional view of a swash plate type compressor incorporating the features of the invention showing a conduit means in fluid communication with the crank chamber and showing the swash plate at a minimum inclination angle.
Figure 2:
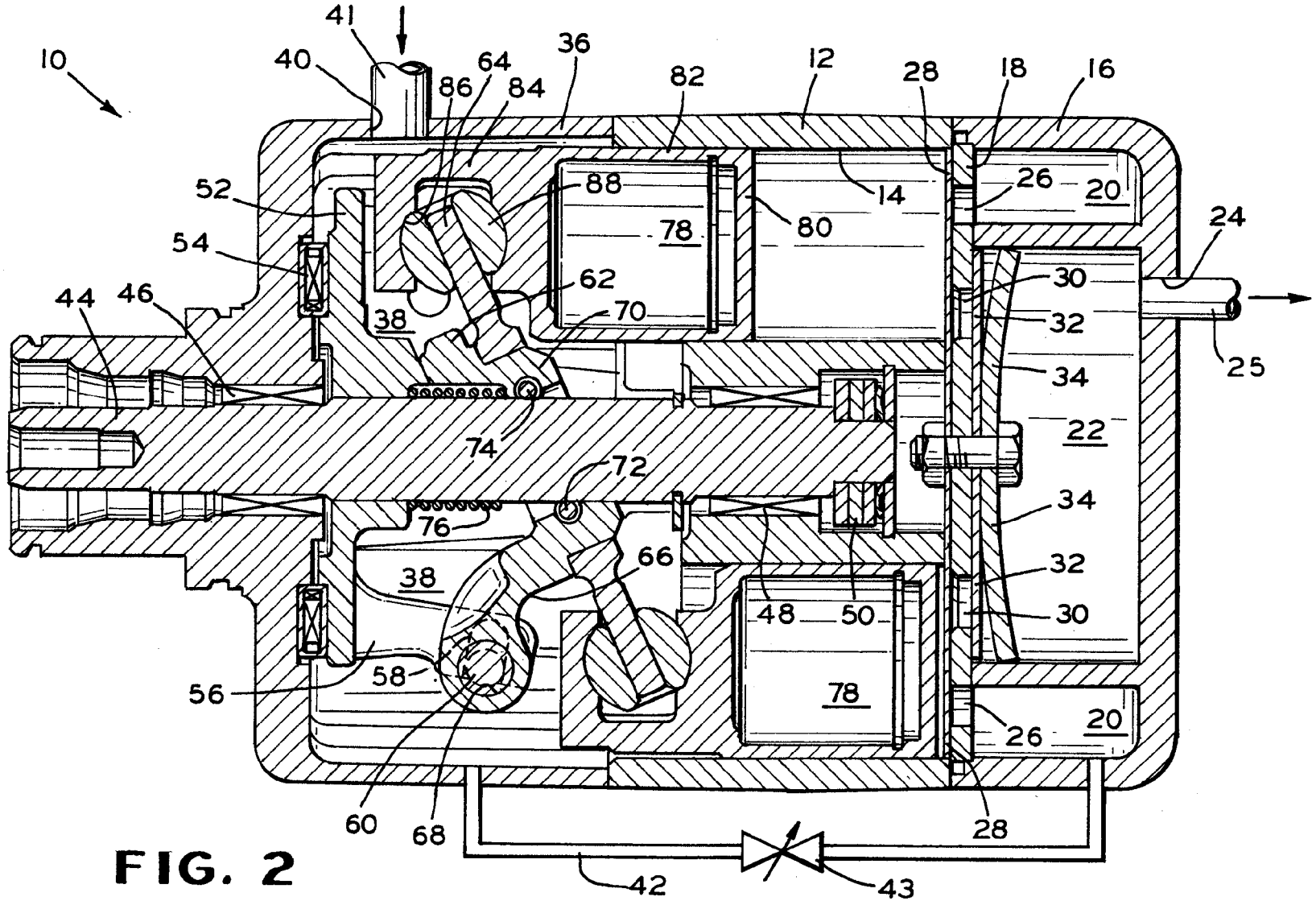
FIG. 2 is a sectional view of the swash plate type compressor illustrated in FIG. 1 showing the swash plate at a maximum inclination angle.

A variable capacity swash plate type compressor incorporating the features of this invention is indicated generally at 10 in FIGS. 1 and 2. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16.

The cylinder head 16 includes a suction chamber 20 and a discharge chamber 22. The discharge chamber 22 has an outlet port 24. An outlet conduit or tubing 25 provides fluid communication between the outlet port 24 and the cooling portion (not shown) of the air conditioning system for a vehicle. The outlet tubing 25 can be formed of any suitable material such as, for example, steel tubing or flexible hose. The suction chamber 20 communicates with each of the cylinders 14 through a respective suction port 26 disposed in the valve plate 18. Each of the suction ports 26 is opened and closed by a suction valve 28. Each of the cylinders 14 communicate with the discharge chamber 22 through a respective discharge port 30 disposed in the valve plate 18. Each of the discharge ports 30 is opened and closed by a discharge valve 32. The opening of the discharge valve 32 is restricted by a retainer 34.

A crankcase 36 is sealingly disposed at the other end of the cylinder block 12 opposite the cylinder head 16. The crankcase 36 and cylinder block 12 cooperate to form an airtight crank chamber 38. The crankcase 36 is provided with an inlet port 40. An inlet conduit or tubing 41 provides fluid communication between the heat exchanger of the cooling portion of the air conditioning system for a vehicle and the inlet port 40. The inlet tubing 41 can be formed of any suitable material such as, for example, steel tubing or flexible hose.

A conduit 42, schematically illustrated in FIGS. 1 and 2, is disposed between the crank chamber 38 and the suction chamber 20. The conduit 42 can be formed of any suitable material such as, for example, steel tubing or flexible hose. The conduit 42 provides fluid communication between the crank chamber 38 and the suction chamber 20. A control valve 43 is disposed in the conduit 42 for controlling the flow of refrigerant gas from the crank chamber 38 to the suction chamber 20. The control valve 43 can be of any conventional type such as, for example, a ball type valve. The control valve 43 is adapted to receive a signal from a remote source to vary the flow of the refrigerant gas therethrough. Either a mechanical or electronic type control valve can be provided. The mechanical type control valve would be arranged to receive either a temperature or pressure control signal from an evaporator (not shown) in the air conditioning system to control the flow of refrigerant gas from the crank chamber 38 to the suction chamber 20. Alternatively, the electronic type control valve would be arranged to receive an electrical signal from a microprocessor (not shown). The microprocessor for the electronic type control valve would monitor the discharge pressure of the compressor, the RPM of the vehicle engine, the temperature difference, the humidity, etc. to control the flow of refrigerant gas from the crank chamber 38 to the suction chamber 20.

A drive shaft 44 is centrally disposed within and arranged to extend through the crankcase 36 and the innermost end thereof is journaled in the cylinder block 12. More specifically, one end of the drive shaft 44 is rotatably supported by a bearing 46 mounted in the crankcase 36 and the other end is rotatably supported in a bearing 48 mounted in the cylinder block 12. Longitudinal movement of the drive shaft 44 is restricted by a thrust bearing 50 mounted in the cylinder block 12.

A rotor 52 is fixedly mounted on an outer surface of the drive shaft 44 adjacent one end of the crankcase 36 within the crank chamber 38. A thrust bearing 54 is mounted on an inner wall of the crankcase 36 in the crank chamber 38 disposed between the crankcase 36 and the rotor 52 and provides a bearing surface for the rotor 52. An arm 56 extends laterally from a surface of the rotor 52 opposite the surface of the rotor 52 that contacts the thrust bearing 54. A rectangular slot 58 is formed in the distal end of the arm 56. A pin 60 has one end slidingly disposed in the slot 58 of the arm 56 of the rotor 52.

A swash plate assembly is formed to include a hub 62 and an annular plate 64. The hub 62 includes arm 66 that extends outwardly and laterally from the surface of the hub 62. A hole 68 is formed in the distal end of the arm 66. One end of the pin 60 is slidingly disposed in the slot 58 of the arm 56 of the rotor 52, while the other end of the pin 60 is fixedly disposed in the hole 68 of the arm 66.

A hollow annular extension 70 extends from the surface of the hub 62 opposite from the arm 66. Two pins 72, 74 are disposed in the hub 62 diametrically opposed to one another with a portion of the outer surface of the pins 72, 74 exposed in the aperture of the annular extension 70 of the hub 62.

The annular plate 64 has a centrally disposed aperture adapted to receive the annular extension 70 of the hub 62, which extends therethrough. The drive shaft 44 is slidably received within the aperture formed in the hub 62 of the swash plate assembly.

A spring 76 is disposed to extend around the outer surface of the drive shaft 44. One end of the spring 76 abuts the rotor 52. The opposite end of the spring 76 abuts the hub 62 of the swash plate assembly.

A plurality of pistons 78 are slidably disposed in the cylinders 14 in the cylinder block 12. The pistons 78 each include a head 80, a dependent skirt portion 82, and a bridge portion 84. The skirt portion 82 terminates in the bridge portion 84. A pair of concave shoe pockets 86 are formed in the bridge portion 84 of each piston 78 for rotatably supporting a pair of semi-spherical shoes 88. The spherical surfaces of the shoes 88 are disposed in the shoe pockets 86 with a flat bearing surface disposed opposite the spherical surface for slidable engagement with opposite surfaces of the annular plate 64 of the swash plate assembly.

The operation of the compressor 10 is accomplished by rotation of the drive shaft 44 by an auxiliary drive means (not shown), which may typically be the internal combustion engine of a vehicle. Rotation of the drive shaft 44 causes the rotor 52 to correspondingly rotate with the drive shaft 44. The swash plate assembly is connected to the rotor 52 by a hinge mechanism formed by the pin 60 slidingly disposed in the slot 58 of the arm 56 of the rotor 52 and fixedly disposed in the hole 68 of the arm 66 of the hub 62. As the rotor 52 rotates, the connection made by the pin 60 between the swash plate assembly and the rotor 52 causes the swash plate assembly to rotate. During rotation, the swash plate assembly is disposed at an inclination angle. The sliding engagement between the annular plate 64 and the shoes 88 causes a reciprocation of the pistons 78 due to the inclination angle of the swash plate assembly. The reciprocation of the pistons 78 causes refrigerant gas to be introduced from the suction chamber 20 of the cylinder head 16 into the respective cylinders 14 in which the refrigerant gas is compressed by the reciprocating motion of the pistons 78. The compressed refrigerant gas is discharged from the respective cylinders 14 into the discharge chamber 22.

The capacity of the compressor 10 can be changed by changing the inclination angle of the swash plate assembly and thereby changing the length of the stroke for the pistons 78. The capacity of the compressor 10 is controlled by the control valve 43, which adjustably changes the flow of refrigerant gas from the crank chamber 38 to the suction chamber 20. Specifically, when an increase in thermal load occurs, the control valve 43 receives a signal from the external source to open and increase the flow from the crank chamber 38 to the suction chamber 20, thereby increasing the pressure in the suction chamber 20. Therefore, the pressure differential between the crank chamber 38 and the suction chamber 20 is decreased and the backpressure acting on the respective pistons 78 in the crank chamber 38 is decreased. As a result, the pin 60 is moved slidably and downwardly within the slot 58, the swash plate assembly is moved against the force of the spring 76, and the inclination angle of the swash plate assembly and the capacity of the compressor 10 are increased, as illustrated in FIG. 2.

Conversely, when a decrease in thermal load occurs, the control valve 43 receives a signal from the external source to close and decrease the flow from the crank chamber 38 to the suction chamber 20, thereby decreasing the pressure in the suction chamber 20. Therefore, the pressure differential between the crank chamber 38 and the suction chamber 20 is increased and the backpressure acting on the respective pistons 78 in the crank chamber 38 is increased. As a result, the pin 60 is moved slidably and upwardly within the slot 58, the swash plate assembly yields to the force of the spring 76, and the angle of inclination of the swash plate assembly and the capacity of the compressor 10 are decreased, as illustrated in FIG. 1.

By introducing the refrigerant gas into the crankcase 36 through the inlet port 40 and thence into the crank chamber 38, instead of introducing the refrigerant gas into the suction chamber 20, several benefits are apparent. The maximum capacity of the compressor 10 has been maximized due to the elimination of an orifice tube fluidly communicating the crank chamber 38 with the discharge chamber 22 of prior art. The orifice tube bypassed compressed refrigerant gas from the discharge chamber 22 to the crank chamber 38, thereby preventing the compressed gas from being used in the cooling portion of the air conditioning system for a vehicle and reducing the efficiency of the compressor 10. By making the crank chamber 38 an active part of the flow path in the present invention, the orifice tube was eliminated and therefore all of the compressed refrigerant gas is available for use in the cooling portion of the air conditioning system.

An additional benefit of the present invention is that since the crank chamber 38 is an active part of the flow path, oil present in the refrigerant gas provides lubrication to the close tolerance moving components of the compressor 10 present in the crank chamber 38. The introduction of the oil to the crank chamber 38 improves the durability of the compressor 10.

Finally, since the volume of the crank chamber 38 is larger than the suction chamber 20, resulting vibration of the compressor 10 from the introduction of the refrigerant gas to the crank chamber 38 compared to introducing the refrigerant gases to the suction chamber 20 of prior art, is reduced. The compressors of prior art required a muffler to reduce the effects of the resulting vibration. By reducing the vibration in the compressor 10, the need for the muffler is eliminated resulting in lower production costs. The reduction in vibration also improves the durability of the compressor 10.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable capacity swash plate type compressor comprising:

a cylinder block;

a cylinder head attached to said cylinder block and cooperating with said cylinder block to form an airtight seal, said cylinder head having a suction chamber and a discharge chamber formed therein;

a crankcase attached to said cylinder block and cooperating with said cylinder block to define an airtight sealed crank chamber;

a first conduit means in fluid communication with a source of refrigerant gas, said first conduit means supplying the refrigerant gas to said crank chamber;

a second conduit means for exhausting refrigerant gas from the discharge chamber;

a third conduit means providing fluid communication between the crank chamber of said crankcase and the suction chamber of said cylinder head, wherein said third conduit means is the sole source of refrigerant gas for the suction chamber; and a control valve disposed in said third conduit means.

2. The compressor defined in claim 1 wherein said control valve adjustably controls the flow of refrigerant gas from the crank chamber of said crankcase to the suction chamber of said cylinder head.

3. The compressor defined in claim 1 wherein said third conduit means is external to the compressor.

4. The compressor defined in claim 3 wherein said control valve is a ball type valve.

5. The compressor defined in claim 4 wherein said control valve is mechanically actuated.

6. The compressor defined in claim 4 wherein said control valve is electronically actuated.

7. A variable capacity swash plate type compressor comprising:

a cylinder block having a plurality of cylinders arranged radially and circumferentially therein;

a cylinder head attached to said cylinder block and cooperating with said cylinder block to form an airtight seal, said cylinder head having a suction chamber and a discharge chamber formed therein;

a crankcase attached to said cylinder block and cooperating with said cylinder block to define an airtight sealed crank chamber;

a drive shaft rotatably supported by said crankcase and said cylinder block in the crank chamber;

a swash plate having a central aperture and opposite surfaces, said drive shaft extending through the aperture of said swash plate;

a plurality of pistons, each of said pistons reciprocatively disposed in an associated one of the cylinders of said block;

a first conduit means providing fluid communication between said crank chamber and a source of refrigerant gas; and a second conduit means for exhausting refrigerant gas from the discharge chamber;

a third conduit means providing fluid communication between the crank chamber of said crankcase and the suction chamber of said cylinder head, wherein said third conduit is the sole source of refrigerant gas for the suction chamber; and a control valve disposed in said third conduit means.

8. The compressor defined in claim 7 wherein said control valve adjustably controls the flow of refrigerant gas from the crank chamber of said crankcase to the suction chamber of said cylinder head.

9. The compressor defined in claim 7 wherein said third conduit means is external to the compressor.

10. The compressor defined in claim 9 wherein said control valve is a ball type valve.

11. The compressor defined in claim 10 wherein said control valve is mechanically actuated.

12. The compressor defined in claim 10 wherein said control valve is electronically actuated.

13. A single headed variable capacity swash plate type compressor comprising:

a cylinder block having a plurality of cylinders arranged radially and circumferentially therein;

a cylinder head attached to said cylinder block and cooperating with said cylinder block to form an airtight seal, said cylinder head having a suction chamber and a discharge chamber formed therein;

a crankcase attached to said cylinder block and cooperating with said cylinder block to define an airtight sealed crank chamber;

a drive shaft rotatably supported by said crankcase and said cylinder block in the crank chamber;

a swash plate having a central aperture and opposite surfaces, said drive shaft extending through the aperture of said swash plate;

a plurality of pistons, each of said pistons reciprocatively disposed in an associated one of the cylinders of said block, each said piston having a pair of shoe pockets;

a rotatable shoe disposed in each of the shoe pockets of each said piston, said shoes being operatively engaged with the opposed surfaces of said swash plate;

a first conduit means providing fluid communication between said crank chamber and a source of refrigerant gas;

a second conduit means for exhausting refrigerant gas from the discharge chamber;

a third conduit means providing direct fluid communication between the crank chamber of said crankcase and the suction chamber of said cylinder head; and a control valve disposed in said third conduit means.

14. The compressor defined in claim 13 wherein said control valve adjustably controls the flow of refrigerant gas from the crank chamber of said crankcase to the suction chamber of said cylinder head.

15. The compressor defined in claim 13 wherein said third conduit means is external to the compressor.

16. The compressor defined in claim 15 wherein said control valve is a ball type valve.

17. The compressor defined in claim 16 wherein said control valve is mechanically actuated.

18. The compressor defined in claim 16 wherein said control valve is electronically actuated.

* * * * *